US011653776B2

(12) United States Patent
Woods et al.

(10) Patent No.: US 11,653,776 B2
(45) Date of Patent: May 23, 2023

(54) VASE WITH RETAINER MOUNTED ON SECURING RING

(71) Applicants: Elise Woods, McKinney, TX (US); James Clayton Weems, McKinney, TX (US)

(72) Inventors: Elise Woods, McKinney, TX (US); James Clayton Weems, McKinney, TX (US)

(73) Assignee: Woods IP Holdings LLC, Phoenix, AZ (US)

( * ) Notice: Subject to any disclaimer, the term of this patent is extended or adjusted under 35 U.S.C. 154(b) by 78 days.

(21) Appl. No.: 17/195,526

(22) Filed: Mar. 8, 2021

(65) Prior Publication Data

US 2021/0274949 A1 Sep. 9, 2021

Related U.S. Application Data

(60) Provisional application No. 62/986,407, filed on Mar. 6, 2020.

(51) Int. Cl.
*A47G 7/07* (2006.01)
*A47G 7/03* (2006.01)

(52) U.S. Cl.
CPC ..... *A47G 7/07* (2013.01); *A47G 7/03* (2013.01)

(58) Field of Classification Search
CPC ..... A47G 7/07; A47G 7/03
See application file for complete search history.

(56) References Cited

U.S. PATENT DOCUMENTS 1,462,947 A * 7/1923 Stuck ..... A47G 7/07 131/242.6
1,629,112 A * 5/1927 MacDonald ..... A47G 7/07 209/403
1,775,250 A * 9/1930 Link ..... A47G 7/07 47/41.13

(Continued)

FOREIGN PATENT DOCUMENTS

CH 382930 A 10/1964
CN 208524374 U 2/2019

(Continued)

OTHER PUBLICATIONS

Website page, Songbird, Where Creativity and Nesting Meet, "How to Arrange a Flower Bouquet" (14 pages), 2021 https://www.songbirdblog.com/easy-trick-flower-arranging-31-days-day/.

(Continued)

*Primary Examiner* — Timothy D Collins
*Assistant Examiner* — Brittany A Lowery
(74) *Attorney, Agent, or Firm* — Bycer & Marion, PLC; Matthew L. Bycer; Michael B. Marion

(57) ABSTRACT

A display vase adapted to hold a variety of longitudinal stems or sticks, the vase including a retainer mountable within the transparent vase that can hold a multitude of display items. The retainer may sit on a shelf or retaining ring inside the vase. The retainer may include an array of hexagonally shaped cells that may interlock with a lower level of interlocking cells. Also included is a method of arranging and displaying stemmed items in a vase. A retainer is set in a vase and stems are secured therethrough, preferably into a frog apparatus at bottom of vase.

20 Claims, 11 Drawing Sheets

(56) References Cited

U.S. PATENT DOCUMENTS 1,868,802 A * 7/1932 Okai ..... A47G 7/03 47/41.13
1,989,952 A * 2/1935 Thomas ..... A47G 7/07 47/41.13
2,057,856 A * 10/1936 Stone ..... A47G 7/07 47/41.13
2,333,561 A * 11/1943 Hamblin ..... A47G 7/03 47/41.13
2,381,253 A * 8/1945 Bierwert ..... A47G 7/07 47/41.11
2,511,162 A * 6/1950 Jackson ..... A01G 5/00 211/175
3,048,942 A * 8/1962 Boetticher ..... A47G 7/03 D11/154
3,183,624 A * 5/1965 Swett ..... A47G 7/06 D7/505
3,477,175 A * 11/1969 Sakamato ..... A47G 7/03 220/605
4,325,202 A * 4/1982 Liard ..... A01G 9/04 47/73
5,161,711 A * 11/1992 Picozza ..... B65D 43/021 220/256.1
5,181,626 A * 1/1993 Daenen ..... B65D 43/021 220/255
5,347,752 A * 9/1994 Black ..... A47G 7/07 248/911
5,758,452 A * 6/1998 Matteucci ..... A47G 7/07 47/41.01
6,189,261 B1 * 2/2001 Helgeson ..... A47G 7/07 47/41.01
6,457,276 B1 * 10/2002 Masters ..... A47G 7/07 47/41.01
2001/0034972 A1 * 11/2001 Masters ..... A47G 7/07 47/58.1 CF
2002/0184818 A1 * 12/2002 Roskin ..... A47G 7/07 47/41.11
2003/0009937 A1 * 1/2003 Delaney ..... A47G 7/07 47/41.01
2005/0050797 A1 * 3/2005 Maniscalco ..... A01G 9/02 47/65.6
2006/0225343 A1 * 10/2006 Thoele ..... A47G 7/07 47/41.11
2009/0307971 A1 * 12/2009 Driscoll ..... B43K 23/001 47/41.01
2010/0095585 A1 * 4/2010 Hall ..... A47G 7/02 47/41.11
2018/0103594 A1 4/2018 Bevacqua
2020/0107656 A1 * 4/2020 Harshman ..... A47G 7/07
2020/0323366 A1 * 10/2020 Luk ..... A01G 5/04

FOREIGN PATENT DOCUMENTS

DE 7607448 U1 10/1976
GB 846794 A 8/1960
KR 980006487 U 4/1998
KR 200241281 Y1 9/2001
NL 1027087 C2 3/2006

OTHER PUBLICATIONS

Website page, Pollen Floral Design Studio, Pollen Chicago, "How I Gave up Floral Foam" (13 pages), Mar. 4, 2019 https://pollenfloraldesign.com/blog/how-i-gave-up-floral-foam/.

* cited by examiner

VASE WITH RETAINER MOUNTED ON SECURING RING

CLAIM OF PRIORITY

The present application includes subject matter disclosed in and claims priority to a provisional application entitled "Vase with Securing Ring" filed Mar. 6, 2020 and assigned Ser. No. 62/986,407, describing an invention made by the present inventor, herein incorporated by reference.

BACKGROUND OF THE INVENTION

1. Field of the Invention

The present invention relates to container displays. The present invention more particularly related to a storage mechanism within a receptacle for display.

2. Description of Related Prior Art

Florists commonly begin an arrangement by placing a criss-cross pattern across the upper opening of a vessel, over the lip onto the outside of the chosen vessel. The grid is then secured to the vase by tightly wrapping another piece of floral adhesive tape around the outside circumference of the lip of the vessel to bind the tape endings to the outside rim of the container, thus holding the grid work in place.

Such a grid is an important means of keeping the stem insertions in place while the arrangement is being developed. The grid also assists in keeping the stems in place during the jostling of the finished product during the delivery process and the installation of the floral piece to its final destination.

Industry professionals have designed alternatives to this grid, such as a series of rubberized bands, woven flexible metallic pipe cleaners, rigid plastic enclosures, and pre-apertured page of adhesive with tabs around the perimeter.

Current plastic cap type grid is also too rigid and does not afford the designer the ability to make insertions at different angles which is often necessary to achieve the proper shape and/or camouflage the mechanics (i.e., the grid itself).

The present invention provides an improvement on display vases for holding and supporting flowers, flower arrangements, or other displays (candy, sticks, etc.) as are known in the art.

There is therefore a need for an easily replaceable retaining grid that can be inserted and locked into a vase.

It is therefore an object of the present invention to provide a replaceable retainer into a receptacle.

It is a further object of the present invention to provide a method for arranging a display within a container.

These and other objects of the present invention will become apparent to those skilled in the art as the description thereof proceeds.

SUMMARY OF THE INVENTION

The present invention is directed to a display assembly device to facilitate arrangement of one or more longitudinal stems. A container, such as a vase, has an open mouth and interior surface. A securing ring or shelf may be set within the container and positioned along the interior surface. The securing or retaining ring may be formed integrally with the vase interior surface, preferably at a neck or higher at a flange opening, and/may be set along a horizontal plane.

A retainer may be set on the securing ring. Preferably, the retainer includes one or a multitude of apertures arrayed for receiving one or more stems therethrough for display above the retainer or outside vase. A frog or pin base may be set on the container bottom at a lower end of the container, preferably interior of the container to allow for fixing of the stems through the retainer withing the vase. The retainer may include a flat or curved array of hexagonal cells. The retainer may include two or more overlapping or stacking arrays, in which all the cells may be any shape, but preferably in hexagonal shape. The arrays may be offset by the width of one half of the cell along a horizontal plane separating the two arrays. The arrays may share a paired perimeter, the perimeter may include feet to interact with the vase interior surface and indentations sized to pair with lugs that may emanate as bosses from a retaining ring or shelf. The perimeter may be in a peg-foot, peg-foot pattern with gaps set therebetween. The arrays may form a disc, and/or may form a rounded shape with tall center (or middle) and narrow along perimeter. The arrays may have a flat interface, with the bulging center formed in each array opposite one another.

A container may be formed for securing display items therein and/or thereover that includes a removable retainer (with at least one aperture) set within the container. The aperture is intended and sized and arranged to secure the lateral movement of an item, such as a longitudinal stem, emplaced therethrough. The retainer may be set upon securing ring within said container, the securing ring either formed integrally with the vase wall, or sitting on shelf, or resting on a narrowing in a neck of the vase. The removable retainer may include a top array of hexagonal cells, and a lower array of hexagonal cells. The retainer can form either hollows or bosses to mate with a securing ring, shelf, etc. into vase. The retainer may have a symmetrical shape with a tall middle and a narrow exterior along a circumference of said retainer. Preferably, the vase and/or securing ring, and/or retainer, and/or frog is transparent and/or translucent.

Also, a method of presenting a display by emplacing one or more longitudinal items into a vase, through an aperture in a retainer. The container is prepared with a securing ring within or near the neck of the container. A retainer is emplaced onto the securing ring, and potentially mated therewith. The retainer is fastened on the securing ring, preferably by interchangeable boss/recess complementary mating. One or more stems or longitudinal bodies can then be set over and through the aperture in the retainer. At the bottom of the container, one or more frogs, e.g., set of pins may stabilize the stems. Once in use, the stems can be removed from the retainer from the securing ring. The stems may be set in the retainer before the retainer is placed in the container. The stems may also be removed with the retainer from the container.

DETAILED DESCRIPTION OF THE PREFERRED EMBODIMENTS

The pattern of wire may mimic chicken wire with hexagonal shapes, but the thickness may or may not be uniform. Spaces may be left uncut for rigidity. While the embodiments presented herein are illustrative of the invention, future versions embodying the present invention are contemplated. In one embodiment, there will be a molded ring inside of the vase, wherein the ring is molded, or otherwise integral with a vase wall, preferably at a cinched neck. Securing ring may include "teeth" that lock into complementary fastening structures on a removable retainer. Teeth may have a mushroom shape to allow the retaining apertures to be slid over a large portion of the aperture (in wire/mesh) and turned to lock in place, as is known in the art.

The present invention includes structures as demonstrated, but should not be considered limited to such embodiments. For instance, the invention includes a standard or custom vase with a bulbous bottom, narrow neck and emerging flanged top. However, the invention does not necessarily require a sealed bottom, which is ideal when water, fluids, or small objects are included, however, in embodiments without these requirements, the bulb, or compote, does not need to be complete. Similarly, the narrowing neck is preferred to hold long items, but the vase may be a simple cylinder. As such the flanged neck includes advantages of encouraging while limiting the spread display.

At the bottom of the vase, pins, or a pin pad may be used as are known in the art, such as those to form a frog. Other alternatives, such as a sponge, or foam, may be used. Towards the neck, or preferably on the narrowest point, or preferably slightly above this neck, a securing ring is secured to an interior surface of the neck. Preferably, this ring circumscribes the interior surface. Preferably, the ring is flat, but may be slanted, depending on requirements. The ring or retainer base, secures a net or retaining wire, or mesh (serving as a cap) on the top of the retainer for support. Preferably, base and top are of a single unitary body, however, the base may be molded into the side of the neck, while the tops may be emplaced thereupon. Alternatively, the top may be fused or coupled with the wire/mesh and include complementary mating features, such as apertures to mate with extending bosses in the base. Similarly, the mesh may include a complementary mating system whereby the base includes vertically emanating bosses to mate with apertures in the mesh. Other snap on, or affixing means as are known in the art may be useful for this function. Additionally, the wire may be formed with the vase.

Figure 1A:
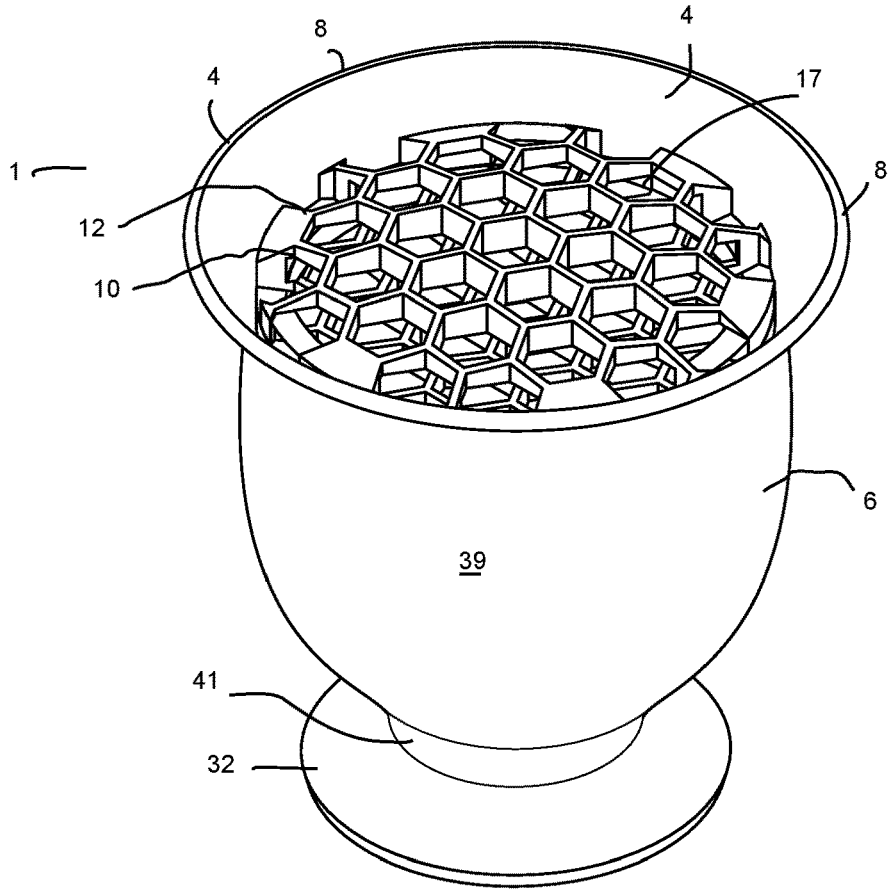
FIG. 1A illustrates a top perspective view of a vase of an embodiment of the present invention.
Figure 1B:
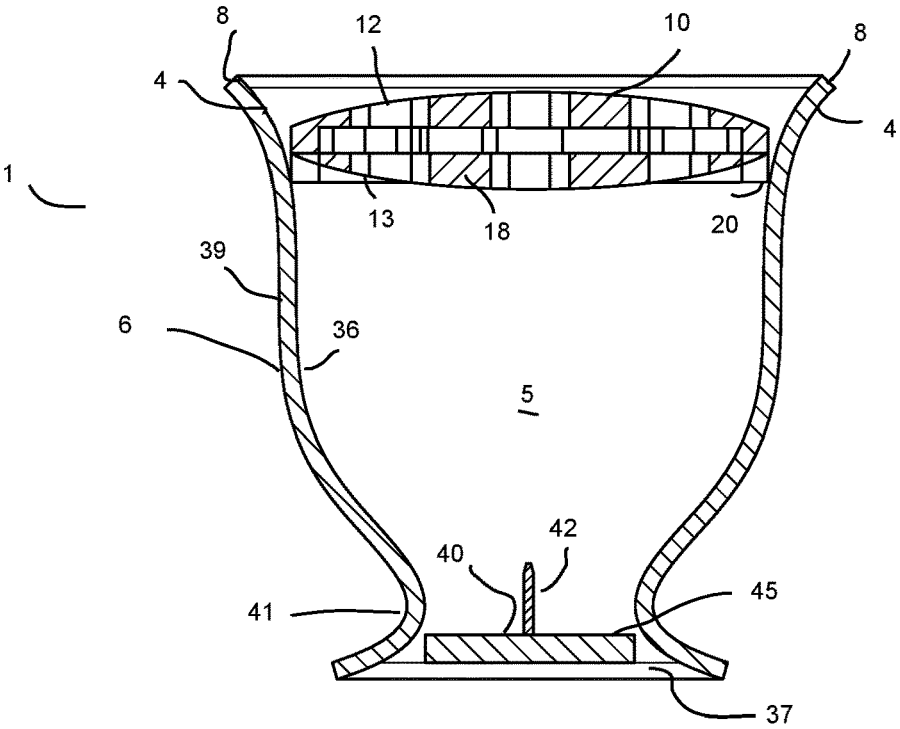
FIG. 1B illustrates a side cross-section al view of an embodiment of the present invention.
Figure 4:
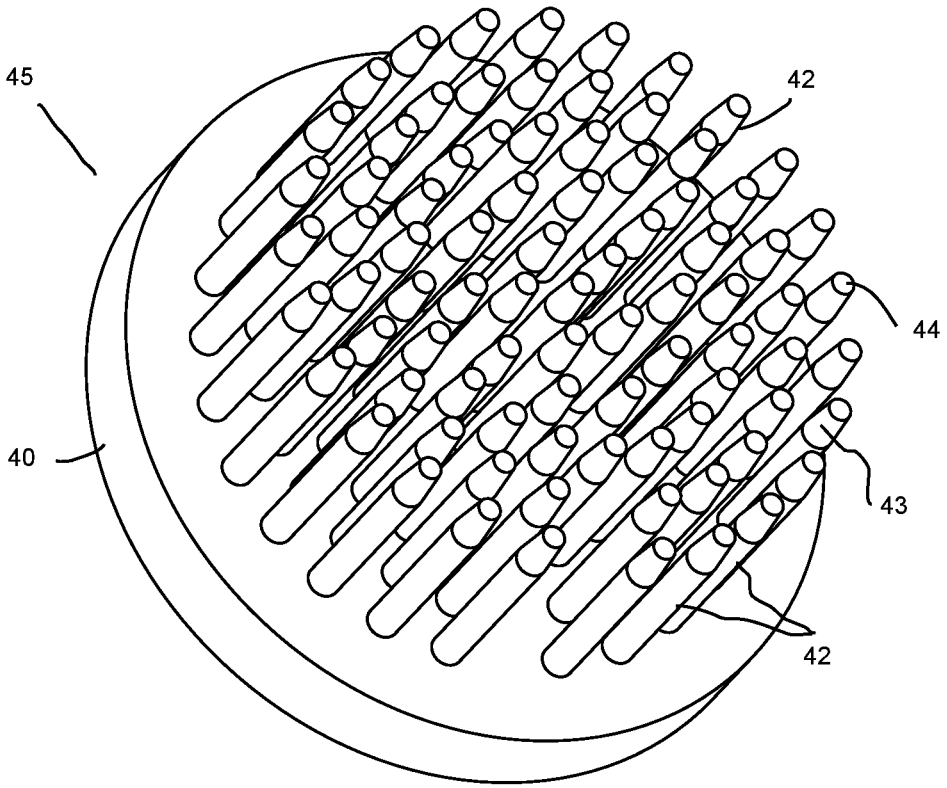
FIG. 4 illustrates a perspective view of a frog of an embodiment of the present invention.
Figure 5:
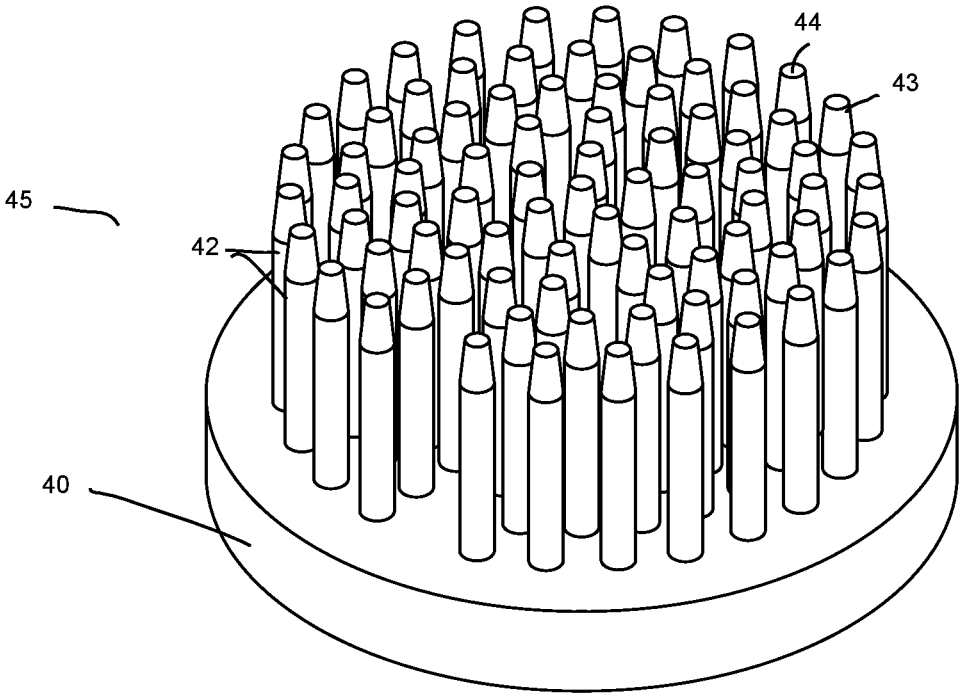
FIG. 5 illustrates a top perspective view of a frog of an embodiment of the present invention.

As can be seen in FIGS. 1A and 1B, vase may be one of a standard set of containers with an open top allowing display over the top of the vase. Display items preferably include stems, or sticks that allow them to rest within vase with a display top, such as stemmed flowers, pops, sticks, or otherwise as are known in the art. Preferably, the bottom is closed to allow containment of a liquid or small articles. Vase 1 includes a large open volume within bulb 6. Flange 4 is separated from bulb 6 via neck 38. Vase 1 includes outer surface 39. Flange 4 includes lip, or edge, 8 that is preferably upwardly-outwardly extended to allow for larger horizontal display parameters. Towards bottom of space 5, a frog system, as is known in the art, may be used to capture and control lateral movement of the lower end of stems. Retainer 10 is set in vase 1, with retainer top 12 facing upwards. Retainer 10 includes apertures 17 though which stems may be placed. Pin base 40 rests along interior surface 36 at bottom 37. Pin base 40 supports one or more numerous vertically aligned pins 42 which may be molded into pin base as a single structure. As shown in FIGS. 4 and 5, frog pin system 45 may include pins 42 set on pin base 40. Each of pins 42 in pin base 40 may include tapered tips 43 with flat top ends 44. As is common, pins 42 may all be set in parallel fashion perpendicularly upright. In alternative embodiments, pins may be set in various, crossing and/or random axes. In an alternative embodiment, pin base may be embedded within bulb bottom 37, and/or pins may be set separably within pin base. Pins are preferably one to two inches in height along the longitudinal axis of each pin, but may be arranged in length, width, and density based on needs of application or use.

As see in FIGS. 9-12, in one embodiment of the present invention, retainer 10 may be used. Retainer 10 may include retainer top 12 along a top side of retainer and retainer bottom 13 along a bottom side of the retainer. Retainer holds a longitudinal stem that is set within the vase space, preferably set within the frogs, and emerges through the retainer out and over opening. Stems entering from above enter through retainer top 12 and through retainer 10, down towards interior of vase and frogs. Retainer top may include features such as receiving apertures 17, or otherwise may include raised nubs or pins to interface with retaining wire 14. It is contemplated that retainer rim 16 will set along shelf 22 set along interior surface 36 of vase 1 along neck 38. Retainer base 18 may be molded into shelf as a permanent fixture into vase 1, or may otherwise be a removable feature. When removable, retainer base may be locked or otherwise affixed into place onto shelf. Where no shelf is used, narrowing of neck 38 may be set to a circumference smaller than retainer base diameter so as to allow retainer base to rest on interior surface at neck. Retainer wire 14 may be set along retainer base 18, wherein a rim 16 of retaining wire 14 fits over, on top of, and preferably into a recess 19 of retainer base 18 along retainer top 12. When retainer base 18 is set upon shelf 22, shelf may include shelf apertures 24 to receive ring bosses 28 or nodes that may set therein. Apertures 24 may be sized and arranged to receive and lock in retainer rim. Ring bosses 28 may include a mushroom head shape 26, or may be straight pins.

Referring now to an alternative embodiment shown in FIGS. 8A-8D, vase 1 may be of an alternative type. Vase 1 includes bulb 6 with an alternative shape, wherein neck does not form in a narrowing circumference smaller than bulb. Shelf 22 rests at neck 38 immediately below flange 4. Vase may include a foot 32 such as an expanding circumferential foot as is shown. Pin base 40 may be set below a lower neck 41 and met with one or more pins 42. Neck may include securing ring 20 along an interior neck surface 64 within vase space 5 at interior surface 36. Securing ring may be integrally formed into vase, or may be resting upon shelf (not shown). Securing ring 20 may include one or more upward facing lugs 68 sized and arranged to complementarily mate with retainer. Retainer rests upon, and may lock into, securing ring 20. Retainer 50 may include one or more hexagonal frames, such as a hexagonal wire frame, or otherwise set with a myriad of walls meeting via hexagonal angles. Retainer rim 16 may include one or more apertures for mating with lugs 68. Retainer 50 may also include horizontal feet 66 to mate with interior surface 36 of vase 1 along neck surface 64. Receiving apertures 53 may be set along securing ring 20 to receive lugs 68.

Figure 2:
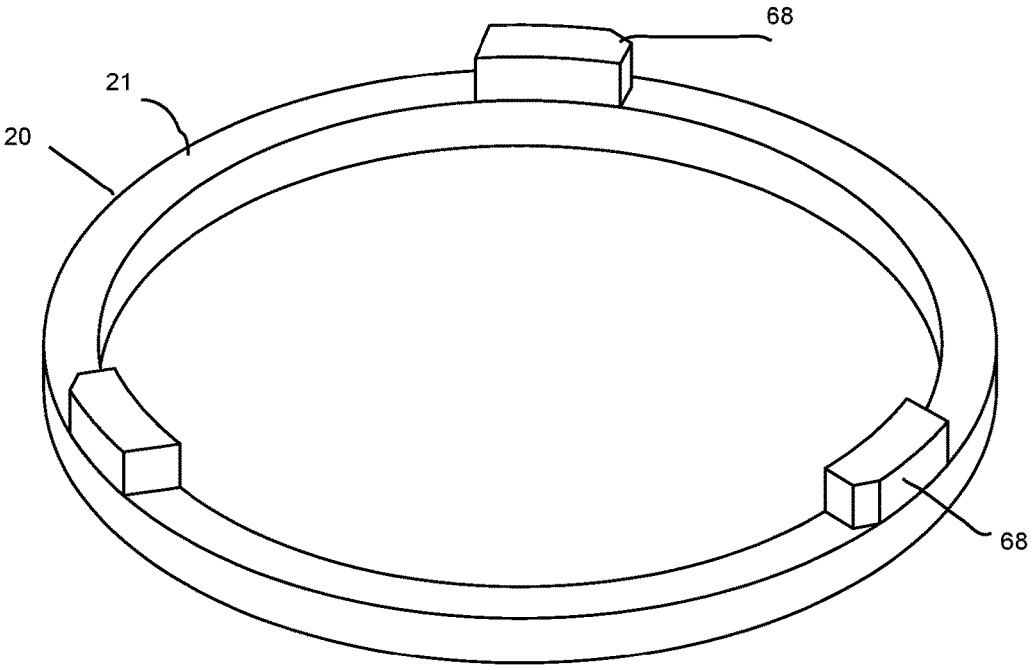
FIG. 2 illustrates a top perspective view of a retaining shelf of an embodiment of the present invention.

As can be seen in FIG. 2, securing ring 20 may be a simple cylindrical ring with one or more mating features on an upper surface 21 such as lugs 68. Securing ring may be molded into the inside of the vase. The retainer, such as a wire replacement module, may snap into securing ring and secured by lugs (also known as teeth).

Figure 3:
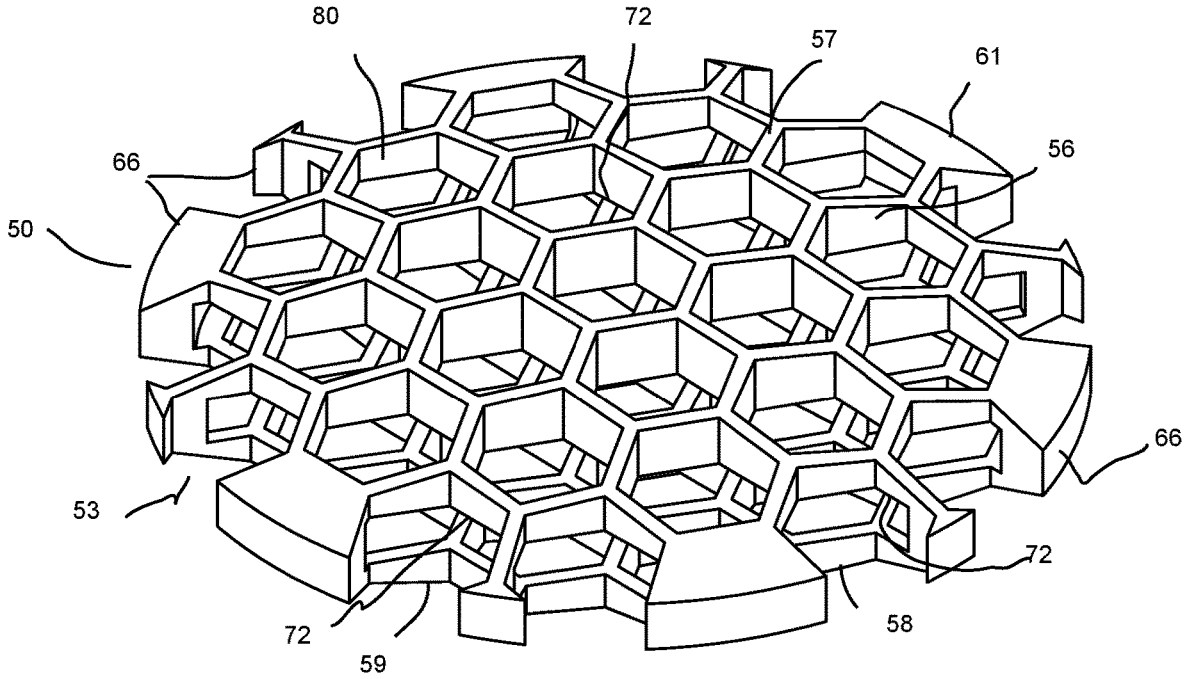
FIG. 3 illustrates a top perspective view of a retainer of an embodiment of the present invention.

Referring to FIGS. 3 et seq., retainer 50 may include an upper array 56 and a lower array 58, each of the upper and lower arrays arranged with hexagonal walls. Upper array 56 being offset in both an X and Y dimension via half the size of a single hexagon shape. Top surface 57 faces open area above vase, while bottom surface 59 faces into vase space 5. Horizontal feet 66 around outside edge 62 are arranged to mate with an interior surface of vase neck and/or rest upon securing ring. Receiving apertures 53 are arranged to mate with securing ring teeth. Further, circumference 60 of retainer 50 may include larger segments 61 allowing to rest upon securing ring. Upper array 56 provides a rounded top shape 57, and a rounded shape may also be formed by bottom 59 in lower array. It is contemplated that upper and lower arrays 56 and 58 are a single molded feature, however they may both be separable features separably locking into securing ring. Retainer 50 is meant to a clear structure, and serve the function of prior art chicken wire and/or other floral structural elements. In some embodiments, retainer 50 is intended to be removed and reattached. Lugs or teeth of the securing ring will allow locking into corresponding apertures 53. In some embodiments, segments 61 are hollowed to allow for locking retainer 50 over retaining ring lugs via placement of apertures over lugs and then rotating retainer so that lugs fit within segments to prevent vertical displacement.

Retainer 50 provides for hexagonal cells 80 that meet one another at cell walls 82. Retainer includes upper edge 84 of upper array 56 to form top surface 57. Similarly, lower array 58 forms lower edge 86 at bottom 59. Hexagonal cells 80 meet one another at intersecting edges 88 to form vertical center line 72. While cells 80 form hexagonal structures when viewed vertically, the intersection of offset upper and lower arrays 56 and 58 form rhomboidal apertures to contain stems set therethrough. Upper array 56 includes hexagonal cells 80 with upper cells 90 that are defined by upper cell walls 92. Offset from upper array, lower array 58 includes hexagonal cells 80 with lower cells 91 that are defined by lower cell walls 94.

The bottom of the vase is intended to include pins molded into a base. The pins allow for stems, sticks, or otherwise longitudinal features to pass through retainer and fit between one or more pins. It is preferable that the pins and base are made from the same material as the vase, or otherwise camouflaged therein. It is preferable that the securing ring will be molded out of a clear polymer so as to not be seen, similarly retainer should be molded from a clear material. In an alternative embodiment, securing ring and/or retainer may be made of a similar color so as to camouflage with vase. In alternative embodiment, colors and materials may vary. Retainer creates a three-dimensional shape to allow multiple points of contact to secure a stem set therethrough. In some applications of the present retainer device, one or more longitudinal stems may be set into retainer in a particular display, and then the retainer with set stems may be attached into vase along securing ring. In some embodiments, lugs will be shaped to snap into receiving apertures in retainer.

Figure 6:
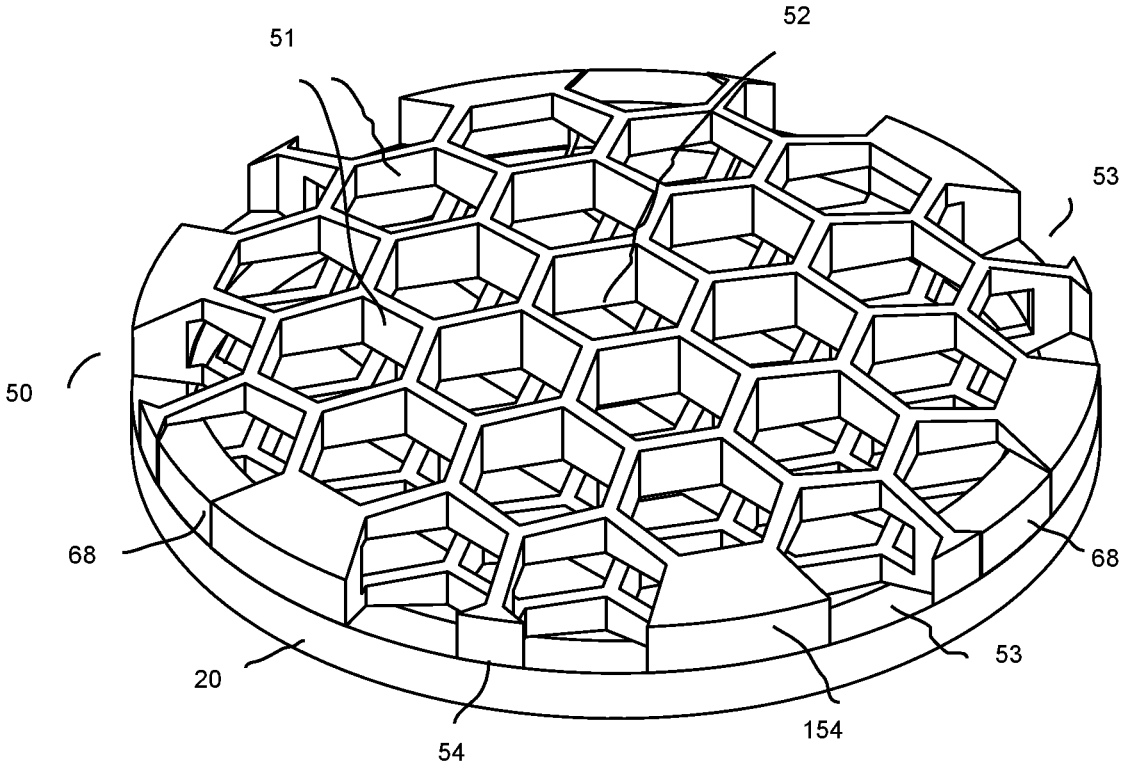
FIG. 6 illustrates a top perspective view of a retainer and ring mated of an embodiment of the present invention.
Figure 7:
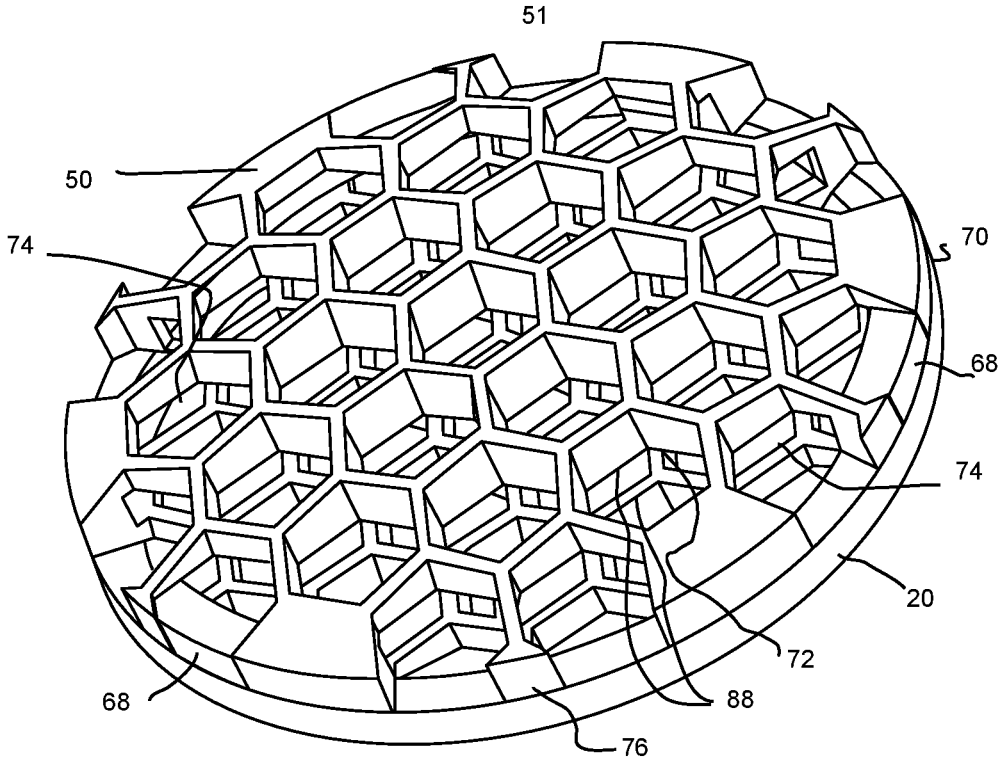
FIG. 7 illustrates a perspective view of a retainer and ring mated of an embodiment of the present invention.
Figure 8A:
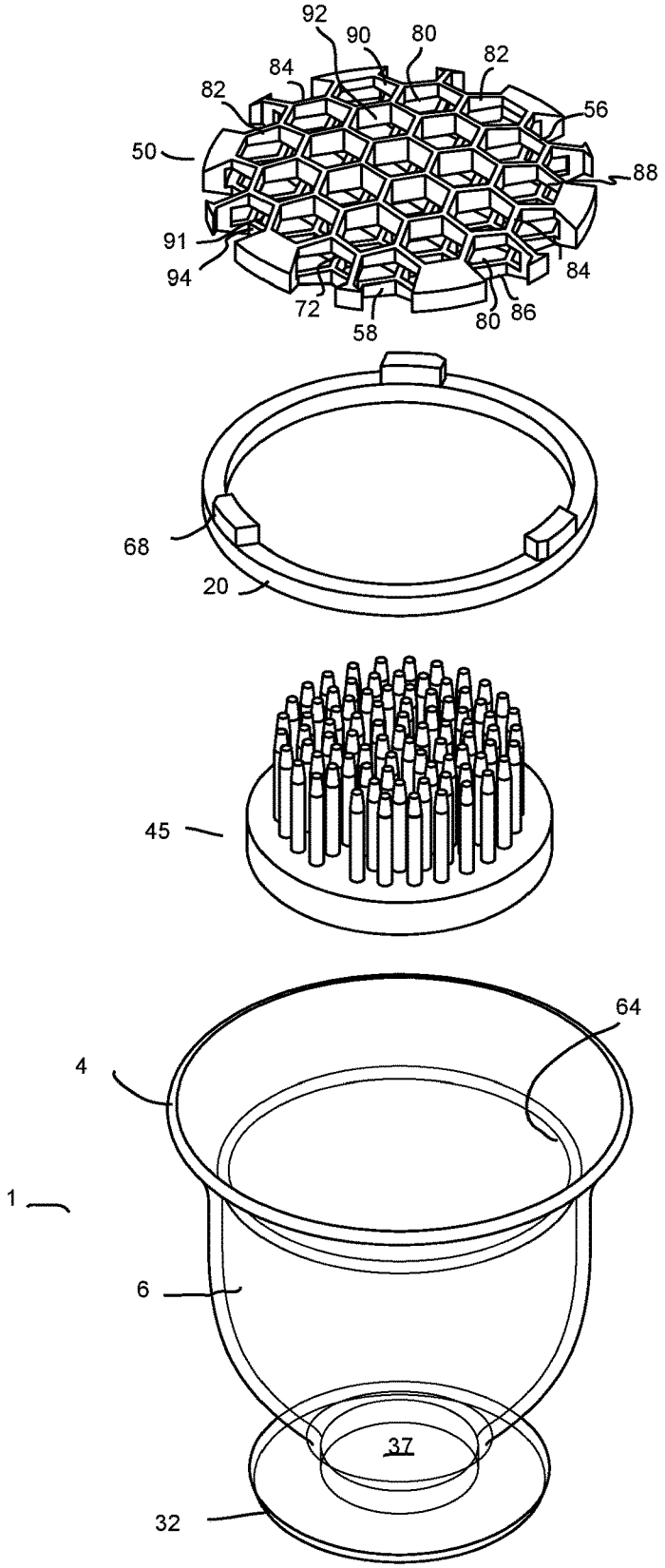
FIG. 8A illustrates an exploded perspective view of a vase of an embodiment of the present invention.
Figure 8B:
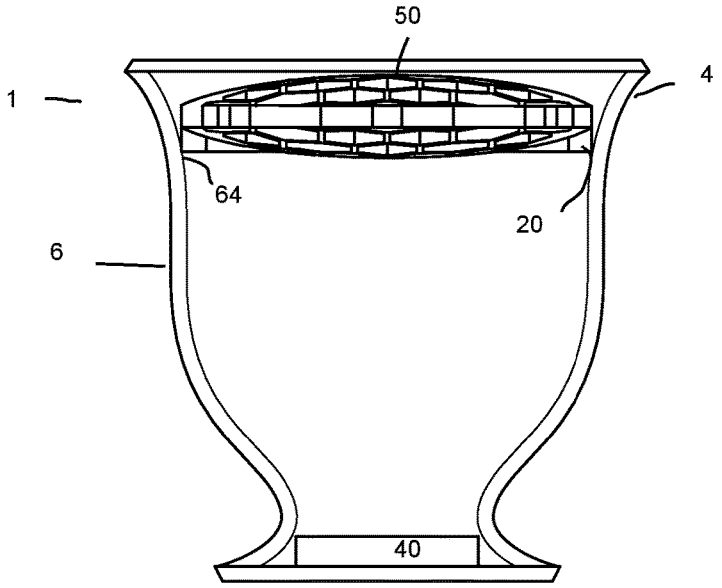
FIG. 8B illustrates a side cross-sectional view of a vase of an embodiment of the present invention.
Figure 8C:
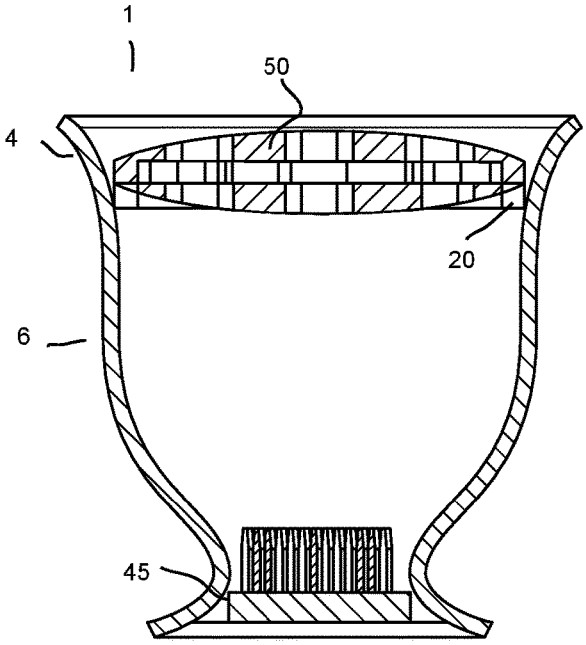
FIG. 8C illustrates a side cross-sectional view of a vase of an embodiment of the present invention.
Figure 8D:
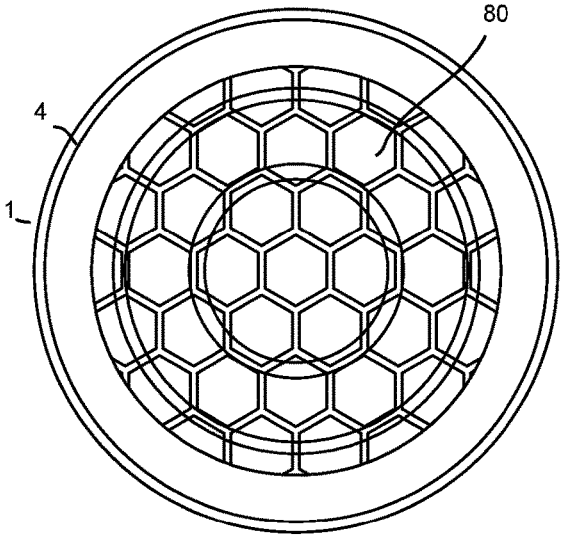
FIG. 8D illustrates a top plan view of a vase of an embodiment of the present invention.
Figure 9:
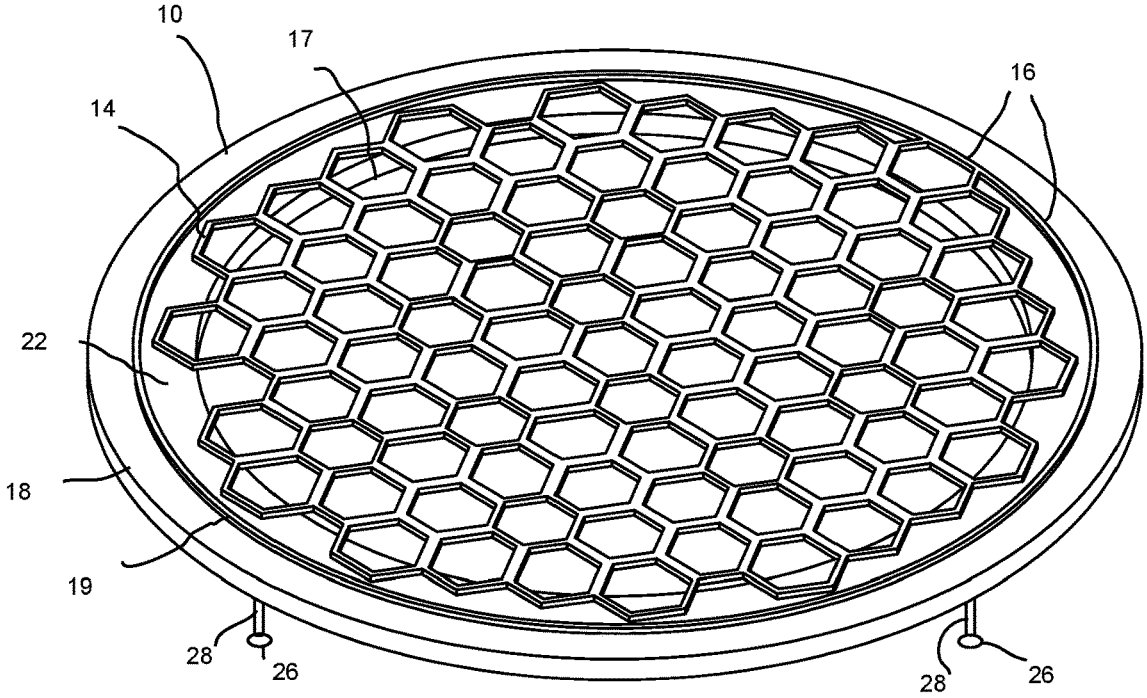
FIG. 9 illustrates a top perspective view of a retainer of an embodiment of the present invention.
Figure 10:
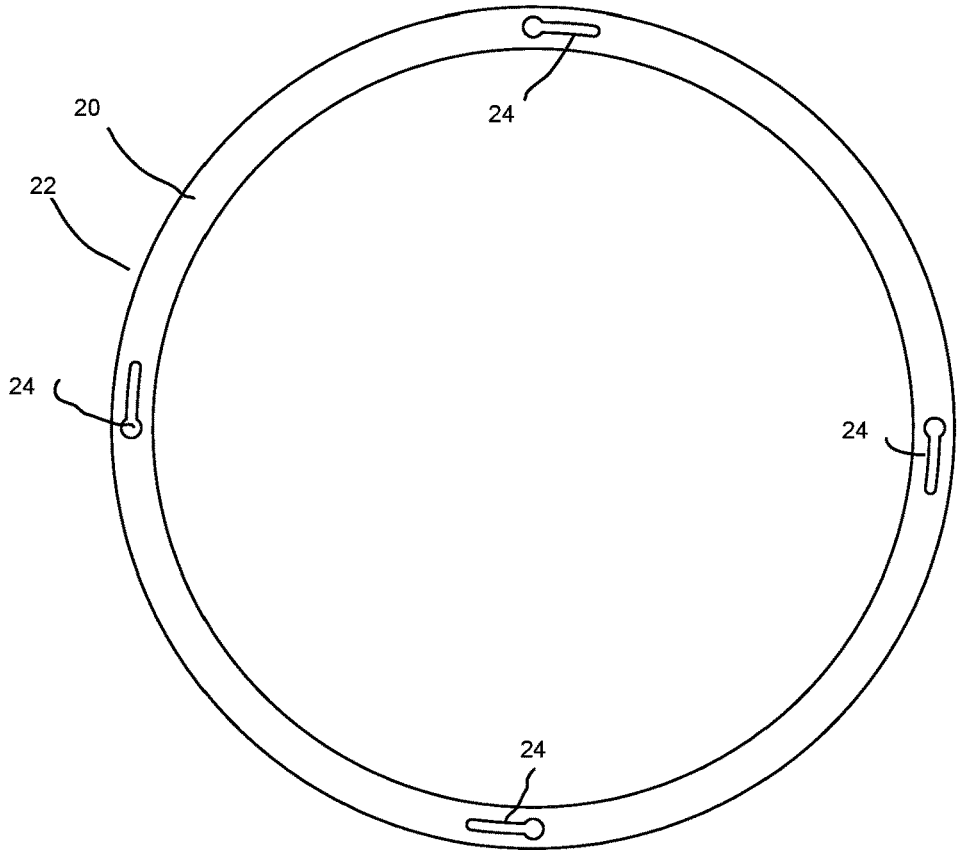
FIG. 10 illustrates a top plan view of a shelf of a vase of an embodiment of the present invention.
Figure 11:
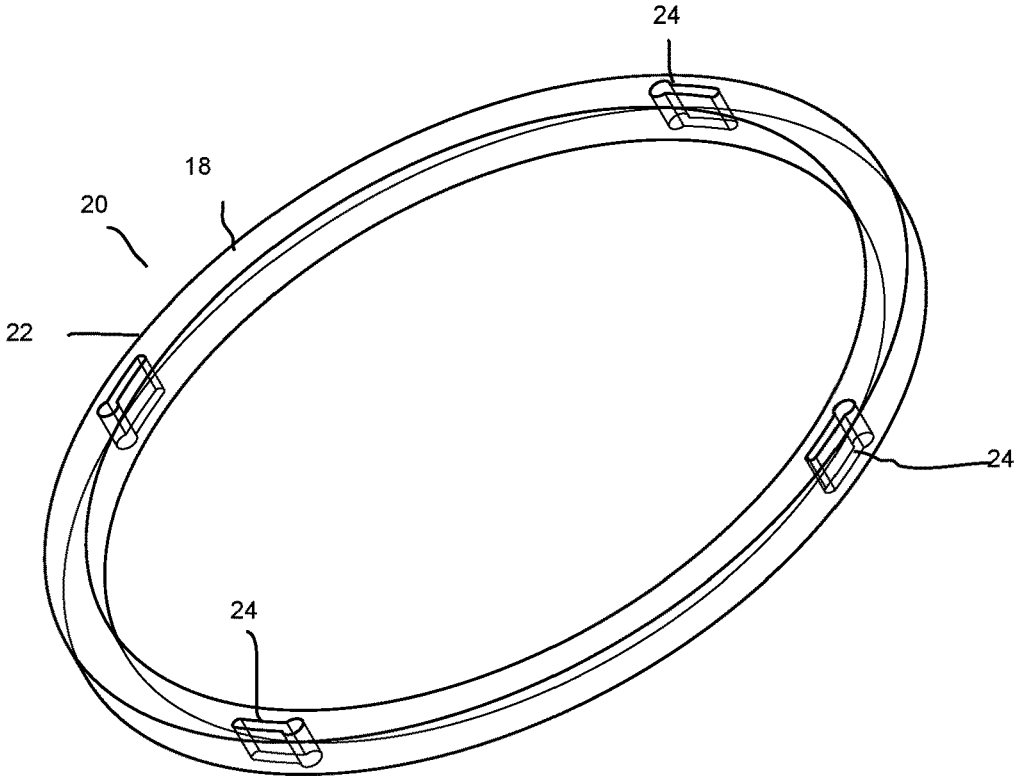
FIG. 11 illustrates a transparent perspective view of the shelf of FIG. 10.
Figure 12:
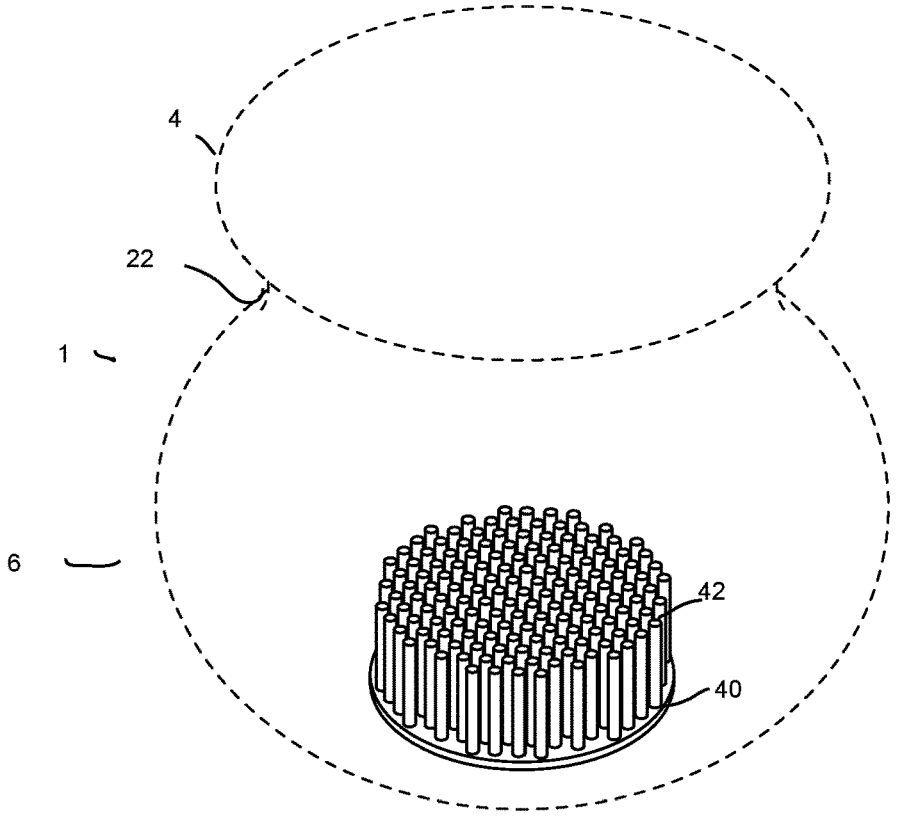
FIG. 12 illustrates a top perspective view of a vase with frog of an embodiment of the present invention.
Figure 13:
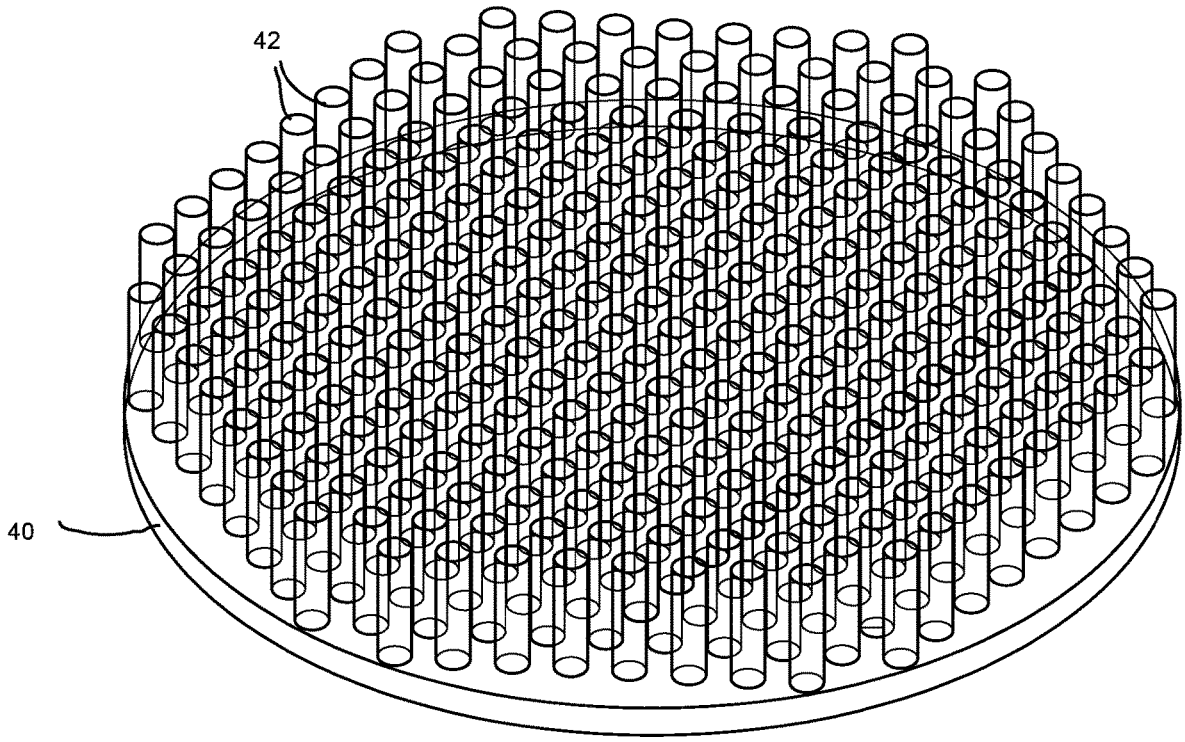
FIG. 13 illustrates a transparent top perspective view of a frog of an embodiment of the present invention.
Figure 14:
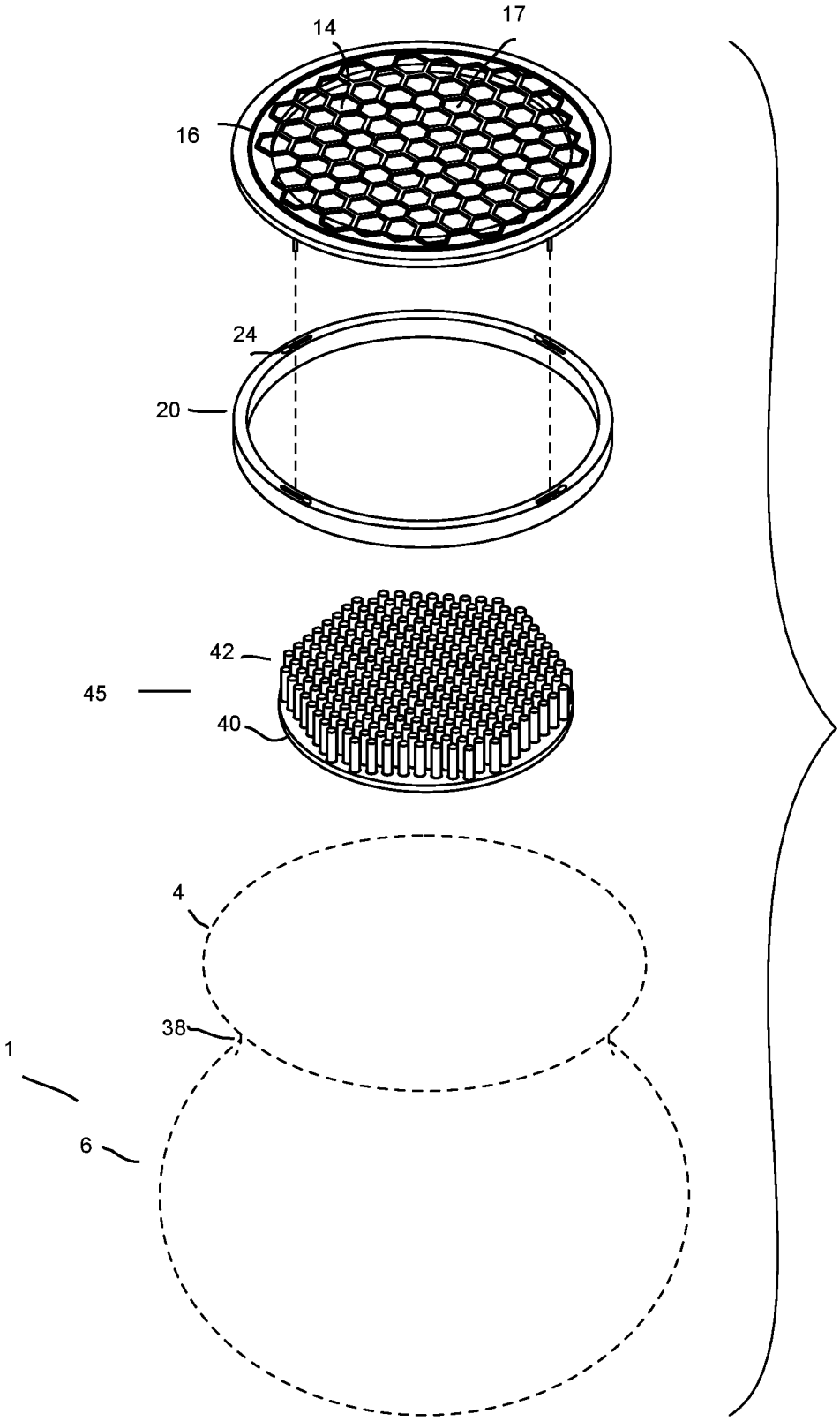
FIG. 14 illustrates an exploded perspective view of a vase of an embodiment of the present invention.
Figure 15:
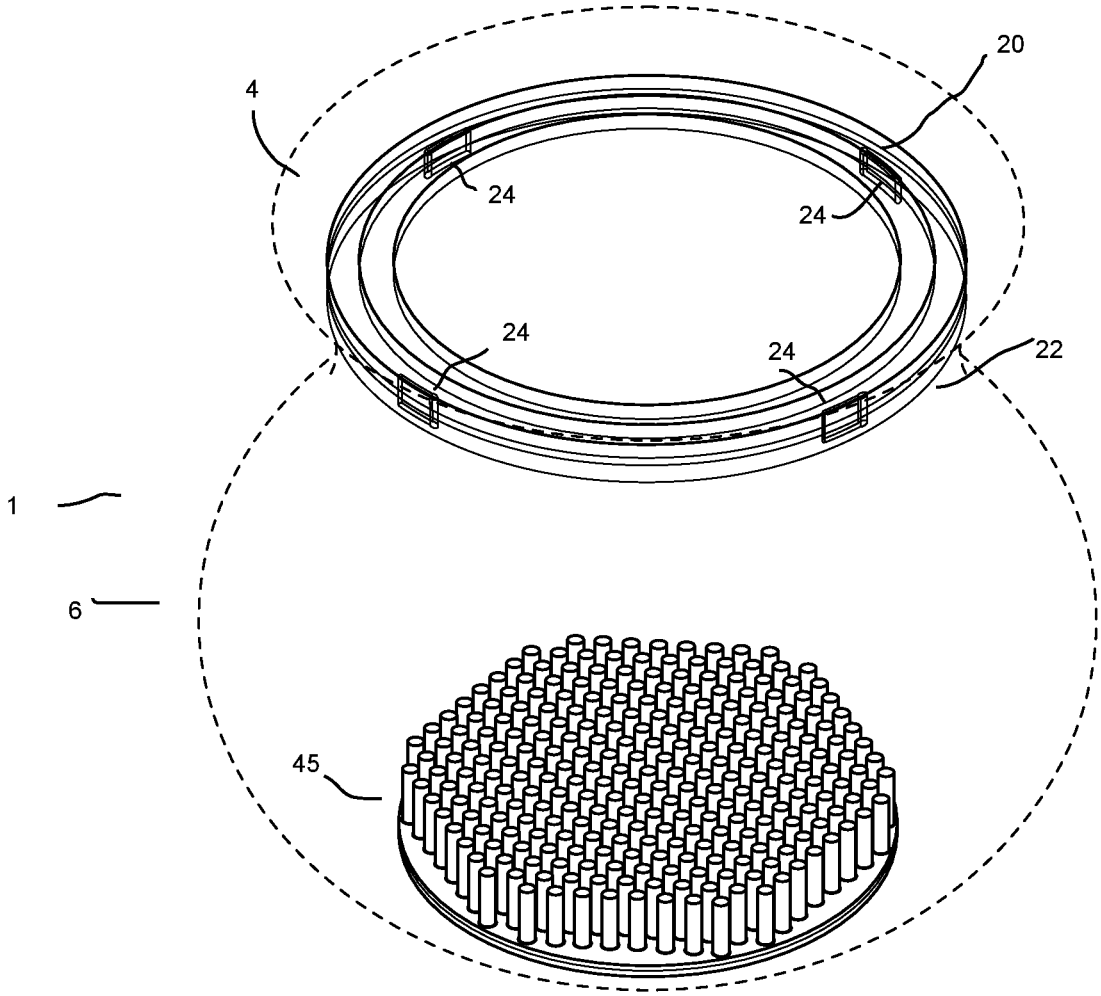
FIG. 15 illustrates a transparent top perspective view of retaining ring and a frog of an embodiment of the present invention.

Preferred embodiments include the use of hexagonal features as apertures in retaining ring. An offset arrangement of upright hexagonal cells (as shown in FIGS. 3, 6, and 7) are preferred. Preferably, cell walls 51 are made of a clear material, such as a plastic or other useful stiff material. To produce an oval shape (at side cross section), walls 51 are taller in center 52 than around edges 53 of retainer perimeter 70. It is preferred that the intersection 150 of the hexagonal arrays are set central relative the overlayed arrayed. Peg 54 may be arranged to provide horizontal securement against the vase interior, peg including widening at a preferably obtuse angle at or exceeding one hundred-twenty degrees, as shown in widening peg 76. Peg 54 may alternate with large feet 154 around perimeter of retainer. In addition, it is preferred that lower and upper arrays join together to form peg feet and large feet to meet vase interior surface and allow lugs to interface therebetween.

We claim:

1. A display assembly device to facilitate arrangement of one or more longitudinal stems, said device comprising
- a container having
- an open mouth;
- an interior surface;
- a securing ring set within the container and positioned along the interior surface; and
- a retainer set along the securing ring, the retainer comprising an upper array of upper cells, each of said upper cells comprising upper cell walls, said upper array positioned above a lower array of lower cells, each of said lower cells comprising lower cell walls; wherein a lower portion of the upper cell walls is set parallel an upper portion of the lower cell walls; said retainer comprising a multitude of apertures through said upper and lower arrays for receiving one or more stems.

2. The display assembly device as set forth in claim 1 further comprising a container bottom set at a lower end of the container, and one or more pins in vertical arrangement along said bottom.

3. The display assembly device as set forth in claim 1 wherein said upper cells comprise upper hexagonal cells, and wherein said upper cell walls are arranged vertically.

4. The display assembly device as set forth in claim 3 wherein said lower cells comprise lower hexagonal cells wherein a lower edge of said upper cells is affixed to an upper edge of said lower cells.

5. The display assembly device as set forth in claim 3 wherein said upper and lower cell walls are taller in a center of said retainer and narrower in height toward an edge of said retainer.

6. The display assembly device as set forth in claim 1 wherein said upper array and said lower array are offset by one-half a width of a single cell along a horizontal plane.

7. The display assembly device as set forth in claim 1 wherein said upper array and said lower array comprise a shared perimeter, said perimeter including feet and receiving indents adapted to complement and mate with a retaining ring rising boss.

8. The display assembly device as set forth in claim 7 wherein said perimeter comprises a peg-foot, peg-foot pattern with gaps set therebetween around said perimeter.

9. The display assembly device as set forth in claim 1 wherein said retainer comprises a receiving aperture set along a circumferential edge, and said securing ring comprises a rising boss adapted to mate with said receiving aperture to secure said retainer over said securing ring.

10. The display assembly device as set forth in claim 1 wherein said securing ring is integrally formed in a side wall of said container.

11. The display assembly device as set forth in claim 10 wherein said securing ring is set along a horizontal plane.

12. The display assembly device as set forth in claim 11 wherein said securing ring is set along a narrowing neck of said container.

13. A container for securing display items therein and/or thereover that includes a removable retainer set within the container, the retainer comprising an upper array of upper cells, each of said upper cells comprising upper cell walls, said upper array positioned above a lower array of lower cells, each of said lower cells comprising lower cell walls; wherein a lower portion of the upper cell walls is set parallel an upper portion of the lower cell walls; said retainer comprising a multitude of apertures through said upper and lower arrays to secure the lateral movement of an item emplaced therethrough, the retainer set upon securing ring within said container, said securing ring supported by the container.

14. The container as set forth in claim 13 wherein said upper cells comprise an upper array of hexagonal cells, and said lower array comprises a lower array of hexagonal cells.

15. The container as set forth in claim 13 wherein said removable retainer comprises a means for mating with said securing ring to support said removable retainer thereon, said removable retainer comprising a symmetrical shape with a tall middle and a narrow exterior along a circumference of said retainer.

16. A method of presenting a display by emplacing one or more items into a vase, through a retainer having at least one aperture, the method comprising the steps of:

preparing a container with a securing ring within a neck of the container;

emplacing a retainer onto the securing ring whereby the retainer positions an upper array upper cells with upper cell walls above a lower array of lower cells with lower cell walls, with a lower portion of the upper cell walls arranged parallel an upper portion of the lower cell walls;

fastening the retainer on the securing ring after said step of emplacing;

locating one or more stems through the retainer;

positioning a bottom end of the one or more stems into a set of pins along a bottom end of the container; and removing the retainer from the securing ring.

17. The method of presenting a display of claim 16 wherein said step of locating is completed prior to said step of emplacing.

18. The display assembly as set forth in claim 4 having a channel comprising a complete perimetric vertical wall comprised of at least a part of said lower portion and at least a part of said upper portion; said channel comprising a rhomboidal aperture.

19. The display assembly as set forth in claim 5 wherein an intersection of upper cell walls and lower cell walls forms a vertical center line.

20. The display assembly as set forth in claim 9 wherein at least one peg in the peg-foot, peg-foot pattern comprises a widening peg at an obtuse angle.

* * * * *